US009346613B2

(12) United States Patent
De Muinck

(10) Patent No.: US 9,346,613 B2
(45) Date of Patent: May 24, 2016

(54) CONTAINER

(71) Applicant: Blue Ocean Containers B.V., Loosdrecht (NL)

(72) Inventor: Ebo Jacques De Muinck, Loenen aan de Vecht (NL)

(73) Assignee: Blue Ocean Containers B.V., Loosdrecht (NL)

( * ) Notice: Subject to any disclaimer, the term of this patent is extended or adjusted under 35 U.S.C. 154(b) by 0 days.

(21) Appl. No.: 14/361,300

(22) PCT Filed: Nov. 19, 2012

(86) PCT No.: PCT/EP2012/072983
§ 371 (c)(1),
(2) Date: May 28, 2014

(87) PCT Pub. No.: WO2013/079345
PCT Pub. Date: Jun. 6, 2013

(65) Prior Publication Data

US 2014/0334747 A1 Nov. 13, 2014

(30) Foreign Application Priority Data

Nov. 28, 2011 (EP) ..... 11190958

(51) Int. Cl.
*B65D 33/06* (2006.01)
*B65D 88/16* (2006.01)
*B65D 88/74* (2006.01)

(52) U.S. Cl.
CPC ..... *B65D 88/1687* (2013.01); *B65D 88/1625* (2013.01); *B65D 88/1681* (2013.01); *B65D 88/741* (2013.01); *B65D 2588/165* (2013.01)

(58) Field of Classification Search
CPC ..... B65D 88/1675; B65D 88/1681; B65D 88/1687; B65D 88/20; B65D 90/0033
USPC ..... 383/16, 24, 12, 17, 18.21, 22, 100, 102, 383/119, 121.1
See application file for complete search history.

(56) References Cited

U.S. PATENT DOCUMENTS

| | | | | |
|---|---|---|---|---|
| 616,249 | A | 12/1898 | Nickerson | |
| 2,696,235 | A * | 12/1954 | Toffolon | 383/18 |
| 4,479,243 | A * | 10/1984 | Derby et al. | 383/24 |
| 4,524,457 | A * | 6/1985 | Marino | 383/17 |

(Continued)

FOREIGN PATENT DOCUMENTS

| | | |
|---|---|---|
| CH | 701338 | 12/2010 |
| DE | 102009060472 | 6/2011 |
| WO | 2011120580 | 10/2011 |

OTHER PUBLICATIONS

International Search Report and Written Opinion from corresponding foreign application PCT/EP2012/072983, filed Nov. 19, 2012.

*Primary Examiner* — Jes F Pascua
(74) *Attorney, Agent, or Firm* — Steven M. Koehler; Westman, Champlin & Koehler, P.A.

(57) ABSTRACT

A container has a box shape and comprises a bottom wall, side walls forming a circumferential wall of the container and a strap. One or more straps form four lifting loops at the upper side of the container and are fixed to the side walls diagonally such that the strap forms a V-shape on each of said side walls between two adjacent lifting loops. The strap can be free from the side walls at lower ends of the V-shapes so as to form fastening loops.

10 Claims, 3 Drawing Sheets

(56) References Cited

U.S. PATENT DOCUMENTS

| | | | | |
|---|---|---|---|---|
| 5,076,710 | A | 12/1991 | Derby | |
| 5,192,134 | A * | 3/1993 | Polett | B65D 88/1618 383/105 |
| 6,120,182 | A * | 9/2000 | Koock | 383/99 |
| 6,220,755 | B1 * | 4/2001 | Brown et al. | 383/119 |
| 6,328,470 | B2 * | 12/2001 | Brown et al. | 383/119 |
| 7,226,209 | B2 * | 6/2007 | Jardine | B25B 5/06 383/24 |
| 2003/0116460 | A1 | 6/2003 | Berke | |
| 2004/0197034 | A1 | 10/2004 | Matias | |
| 2007/0127852 | A1 * | 6/2007 | Town | B65D 88/1618 383/16 |
| 2008/0273820 | A1 * | 11/2008 | Wiker et al. | 383/103 |

* cited by examiner

CONTAINER

CROSS-REFERENCE TO RELATED APPLICATION

This application is a Section 371 National Stage Application of International Application PCT/EP2012/072983 filed Nov. 19, 2012 and published as WO2013/079345 A1 in English.

BACKGROUND

The discussion below is merely provided for general background information and is not intended to be used as an aid in determining the scope of the claimed subject matter.

Aspects of the present invention relate to a container having a box shape and comprising a bottom wall, side walls forming a circumferential wall of the container, a strap which forms four lifting loops at the upper side of the container and which is fixed to the side walls diagonally such that the strap forms a V-shape on each of said side walls between two adjacent lifting loops.

Such a container is known in the art. The lifting loops are located at the top of the container for carrying the container by means of a forklift truck. Due to the V-shapes of the strap on the side walls the load stress in the container is distributed evenly.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the Background A container according to an aspect of the invention, includes a strap that is free from the side walls at lower ends of the V-shapes so as to form fastening loops.

Due to the presence of the fastening loops at the side walls of the container a support, such as a pallet, can be attached easily to the bottom wall of the container, for example by means of a rope which is drawn through the fastening loops and holes in the support. This is advantageous compared to fixing a support to the bottom wall of the container by means of a rope that extends over the top of the container, since this might lead to damage of a product in the container.

It is noted that the forces in the container upon lifting by means of the lifting loops are mainly guided by the strap such that the side wall may be made of a light-weight, thin and flexible material such as a cloth or a sheet web.

The container may have four side walls which form four corners, wherein the lifting loops extend diagonally over said corners. In this case the container has a block shape and a rectangular cross-section as seen from above.

In practice the strap may be formed of a plurality of strap pieces which are secured to each other, for example by means of stitching.

The side walls may be made of a cloth material and reinforced by reinforcement plates.

In a preferred embodiment the reinforcement plates are located at corners where side walls meet each other, whereas central portions of the side walls are free from reinforcement plates, wherein the width of the central portion of a side wall is larger than half of the width of one of the reinforcement plates at the corners. This appears to be allowable for several types of products that are put in the container, due to the presence of the V-shaped strap on the side walls. Leaving out a reinforcement plate in central portions of the side walls results in a lower empty weight and volume of the container, also in folded condition.

In a specific embodiment the side walls and/or the bottom wall are provided with perforations for creating ventilation. This is typically desired in case the container is used for storage and transport of vegetables, fruit, etc. The perforations may be applied in the reinforcement plate-free central portions of the side walls. It is also conceivable that the side walls of the container are entirely provided with reinforcement plates and wherein the reinforcement plates are also provided with perforations.

The total surface of the perforations may be larger than 1% of the circumferential surface of the container.

An alternative embodiment of the container has a box shape and comprises a bottom wall, side walls that form a circumferential wall of the container, a strap which forms four lifting loops at the upper side of the container and which is fixed to the side walls diagonally such that the strap forms a V-shape on each of said side walls between two adjacent lifting loops, wherein at least two opposite side walls are provided with fastening loops which provide the opportunity to fix a pallet to the bottom wall of the container, for example by means of a rope which is drawn through the fastening loops and holes in the support.

An aspect of the present invention also relates to a container for receiving a big bag, having a box shape and comprising a bottom, a front side, an opposite rear side and two opposite lateral sides extending between the front side and the rear side, wherein the sides form a circumferential wall of the container, front lifting straps at corners where the front side and the lateral sides meet, and rear lifting straps at corners where the rear side and the lateral sides meet, at least two guides located at the respective lateral sides and joined to the respective corresponding rear lifting straps such that under operating conditions forks of a fork lift truck can be guided by said guides through the rear lifting straps after being moved through the front lifting straps towards the rear lifting straps.

Such an assembly is known in the art. The bottom and circumferential wall are often made of a cloth material and reinforced by reinforcement plates. The lifting straps are located at the top of the container for carrying the container by means of a forklift truck. This means that a supporting pallet can be omitted. The guides facilitate the work for a forklift truck driver since they serve to guide the forks through the rear lifting straps after being moved through the front lifting straps.

It is an object of the present invention to provide an improved container.

A container according to an aspect of the invention has rear lifting straps, each strap having joint portions where the strap is joined to the guide and the rear side, and a free portion extending between the joint portions, wherein the container is configured such that the free portions of the respective rear lifting straps allow the guides to be displaced between a location at least partly within the circumferential wall of the container and a location outside the circumferential wall of the container.

Due to this feature the container can be switched between a transporting condition in which the guide is located at least partly within the circumferential wall of the container and a content handling condition in which the guide is located outside the circumferential wall of the container. This means that in the content handling condition an operator can have free access to the content of the container, for example during filling or emptying the big bag in the container, without being obstructed by the guides. Furthermore, if the circumferential wall is provided with reinforcement plates, that should be inserted into openings nearby the guide, this can be facilitated by displacing the guide to another side of the circumferential wall if it obstructs the action.

The respective joint portions that are joined to the rear side may extend from respective fixing locations at an upper edge portion of the rear side obliquely downwards, wherein the fixing locations are located at a distance from the respective corners where the respective rear side and the lateral sides meet. This is advantageous in terms of distributing a lifting force on the rear side.

In an alternative embodiment the respective joint portions that are joined to the rear side may be joined at respective fixing locations at an upper edge portion of the rear side, wherein the length of the free portion is larger than the distance between the fixing location and the closest corner in order to displace the guide between the transporting condition and the content handling condition easily.

The respective joint portions that are joined to the guide may also be joined to the respective lateral sides. In a specific embodiment they are attached to the lateral sides along the respective corners where the rear side and the lateral sides meet.

The guides may also be joined to the respective front lifting straps such that one front lifting strap is directly coupled to one rear lifting strap via the corresponding guide.

Furthermore, the guides may extend parallel to each other along upper edge portions of the lateral sides, the guides may be tubular shaped, and the guides may be joined to the lateral sides, for example at an upper portion thereof.

In a preferred embodiment the container is substantially symmetric with respect to a plane extending transversely with respect to the bottom, since this may allow an operator of a forklift truck to take up the container when approaching the container from opposite directions, for example.

An aspect of the invention is also related to a lid which is suitable for closing a container as described hereinbefore. The lid has a box shape and includes an upper wall and side walls. The upper wall is provided with tunnel shaped portions which extend substantially parallel to each other and protrude in a direction away from the side walls. It is noted that the lid is also suitable for containers including lifting straps which are not provided with guides.

An aspect of the invention is also related to a container for receiving a big bag, having a box shape and comprising a bottom and side walls, wherein one of the side walls comprises at least a reinforcement plate including a valve, and wherein the reinforcement plate is provided with rigid reinforcement bars extending upwardly with respect to the bottom at both sides of the valve. The advantage of the reinforcement bars is that bulging out of the reinforcement plate in case of a filled big bag in the container is minimized. Without reinforcement bars, a valve which is normally located at a lower portion of the container tends to direct downwardly due to bulging of the reinforcement plate. This effect is reduced by the reinforcement bars and their orientation.

In a preferred embodiment the distance between an outer side of the bars and the reinforcement plate is the same as or larger than the distance between an outer side of the valve and the reinforcement plate, since this prevents the valve from being damaged from the outside of the container easily.

The reinforcement plate and the reinforcement bars may be made of one piece, for example by means of folding side edge portions of a flat reinforcement plate inwardly.

It is noted that it is not necessary to combine the reinforcement plate including the reinforcement bars with a container having lifting straps.

An aspect of the invention is also related to an assembly of a container and a big bag, wherein the big bag is received by the container, and wherein the container has a box shape and comprises a bottom and side walls, and wherein the assembly is provided with a tightening member for pulling opposite sides of the big bag at an upper portion thereof to each other in a filled condition. Due to the presence of the tightening member the movement to-and-fro of the content of the big bag at the upper portion of the container is minimized. Without the tightening member the content, for example a liquid, tends to slosh within the container during transport which may result in accelerated wear of the big bag and/or container due to repeated friction between their contact surfaces.

The tightening member may be attached to at least one of the side walls or the bottom of the container. In a more preferred embodiment the tightening member is attached to the side walls by clamping a portion of the tightening member between the container and the big bag in a filled condition.

In a practical embodiment of the assembly the tightening member has at least partly a tubular shape and surrounds at least an upper portion of the big bag, wherein the tightening member has an upper end portion including a circumferential drawing string for pulling the upper end portion together. This appears to improve the stability of a filled bag within the container significantly. In a simple embodiment the tightening member has a bag shape which envelopes the big bag.

It is noted that it is not necessary to combine the tightening member with the container including lifting straps or the container including the reinforcement plate and the reinforcement bars.

BRIEF DESCRIPTION OF THE DRAWINGS

Aspects of the invention will hereafter be elucidated with reference to the schematic drawings showing an embodiment of the invention by way of example.

DETAILED DESCRIPTION

Figure 1:
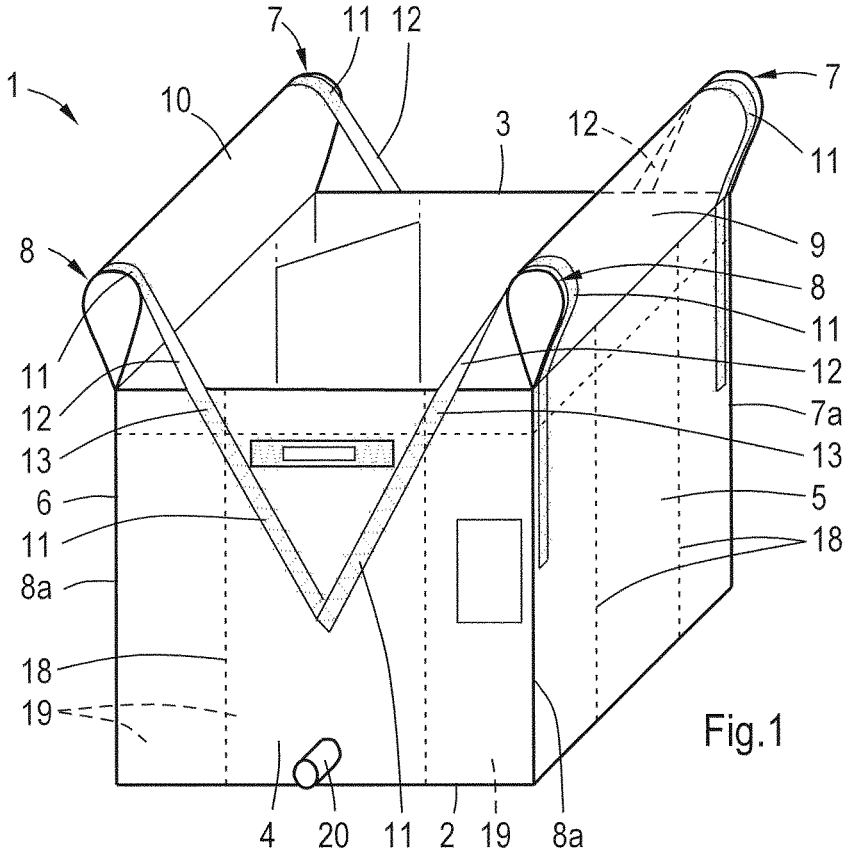
FIG. 1 is a perspective view of an embodiment of a container, illustrating a transporting condition.
Figure 2:
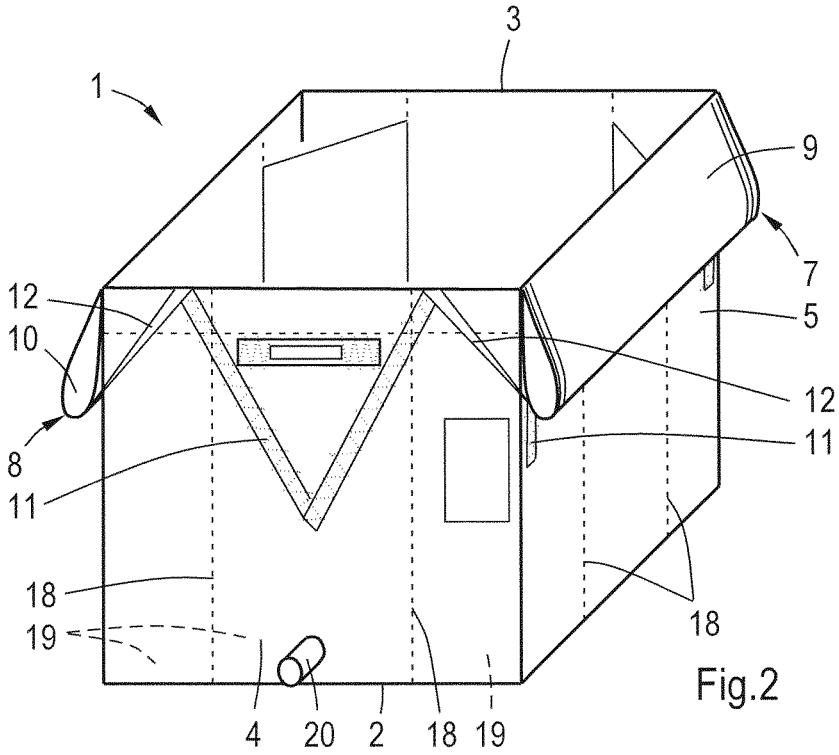
FIG. 2 is a similar view as FIG. 1, but illustrating a content handling condition.

FIGS. 1 and 2 show an embodiment of the container 1. The container 1 is suitable for receiving a big bag (not shown) which can be filled with a liquid, powder or the like. Such an assembly is also known as a bag-in-box. FIG. 1 shows the container 1 in a transporting condition in which the container 1 can be carried by an elevating truck, whereas FIG. 2 shows a content handling condition which provides an operator access to the content of the container 1, for example during filling or emptying the big bag in the container 1.

The container 1 comprises a bottom 2 which can be made of a cloth and possibly reinforced by a reinforcing plate. Furthermore, the container 1 is provided with a front side 3, an opposite rear side 4 and two opposite lateral sides 5, 6, which form a circumferential wall of the container 1. The lateral sides 5, 6 extend between the front side 3 and the rear side 4. In the embodiment as shown the container 1 has a cubic shape, hence the circumferential wall of the container 1 has a square cross section, but an alternative cross-sectional shape such as a rectangle is conceivable. The front side 3, the rear side 4 and the lateral sides 5, 6 are attached to the bottom 3 and can be made of the same material, for example a flexible material such as a cloth of plastic.

The container 1 is provided with front lifting straps 7 at corners 7*a* (one of which is illustrated) where the front side 3 and the respective lateral sides 5, 6 are adjacent to each other. Similarly the container 1 is provided with rear lifting straps 8 at corners 8*a* where the rear side 4 and the respective lateral sides 5, 6 are adjacent to each other. Each of the lifting straps 7, 8 can be made of one piece, for example in a woven or braided material. The lifting straps 7, 8 are attached to the circumferential wall 3-6 of the container 1 such that they form a loop and project upwardly from the corners 7*a*, 8*a* in the transporting condition as illustrated in FIG. 1. This allows the container 1 to be taken up by a forklift truck by means of inserting the forks of the forklift truck through the front and rear lifting straps 7, 8 and lifting the container 1.

It is desired that the loops which are formed by the rear lifting straps 8 remain open in order to facilitate insertion of the forks of a forklift truck through the rear lifting straps 8 after they have passed the front lifting straps 7. This is achieved by parallel tubular guides 9, 10, which are fixed at upper side portions of the lateral sides 5, 6. In the embodiment as shown the guides 9, 10 are fixed to the front and rear lifting straps 7, 8. The guides 9, 10 may be made of the same material as the sides 3-6 and the bottom 2 of the container 1. The guides 9, 10 are adapted such that they make or keep the loops of the rear lifting straps 8 open when forks of a fork lift truck move through the guides 9, 10 in a direction from the front lifting straps 7 to the rear lifting straps 8.

Each of the rear lifting straps 8 has joint portions 11 where the strap 8 is sewn to the corresponding lateral side 5, 6, and the guide 9, 10, on the one hand, and the rear side 4, on the other hand. The rear lifting strap 8 also comprises a free portion 12 which extends between the joint portions 11. The free portion 12 is free and displaceable with respect to the guides 9, 10 and the circumferential wall 3-6 of the container 1.

In the embodiment as shown in FIGS. 1 and 2 the container 1 is substantially symmetric with respect to a plane that extends transversely with respect to the bottom 2 of the container 1 and which extends parallel to one of the sides through the center of the container 1. As a consequence, the front lifting straps 7 also have joint portions 11 which are sewn to the respective corresponding lateral sides 5, 6, and the guides 9, 10, on the one hand, and the front side 3, on the other hand, in a similar way as at the rear side 4, whereas the free portions 12 of the front lifting straps 7 also extend between the respective joint portions 11.

The respective joint portions 11 of the front and rear lifting straps 7, 8 that are joined to the respective guides 9, 10 are also joined to the respective lateral sides 5, 6 in the embodiment as shown. These joint portions 11 are sewn parallel or along portions of the respective corners 7*a*, 8*a* in this embodiment, see FIG. 1.

FIGS. 1 and 2 show that the joint portions 11 of the rear lifting straps 8 are attached to the rear side 4 and extend from respective fixing locations 13 at an upper edge portion of the rear side 4 obliquely downwards. The fixing locations 13 are located at a distance from the respective corners 8*a*. It can be seen that the joint portions 11 of the rear lifting straps 8 form a V-shape on the rear side 4. The joint portions 11 of the front lifting straps 7 are attached in a similar manner to the front side 3. The oblique attachment of the joint portions 11 to the respective front and rear sides 3, 4 is advantageous in terms of distributing the lifting force over the sides 3, 4. Particularly, if the circumferential wall of the container 1 is provided with reinforcing plates 19 as illustrated by planes between vertical dotted lines 18 in FIGS. 1 and 2, a central reinforcement plate 19 would tend to move downwardly with respect to the neighboring reinforcement plates 19 upon lifting the container 1 in case the joint portions 11 were not attached to the side at the central reinforcement plate 19. The latter effect is less at the lateral sides 5, 6 since the guides 9, 10 themselves will distribute a lifting force over the lateral sides 5, 6, because the guides 5, 6 are fixed to the lateral sides 5, 6 substantially along their entire length in this embodiment.

Due to the free portions 12 of the straps 8 it is possible to move the guides 9, 10 outwardly outside the circumferential wall of the container 1. This content handling condition is illustrated in FIG. 2. In the transporting condition as shown in FIG. 1 the guides 9, 10 are located within the circumferential wall of the container 1 or at least partly within the circumferential wall of the container 1 such that the front and rear lifting straps 9, 10 are located above the sides 3-6 of the container 1.

Figure 3:
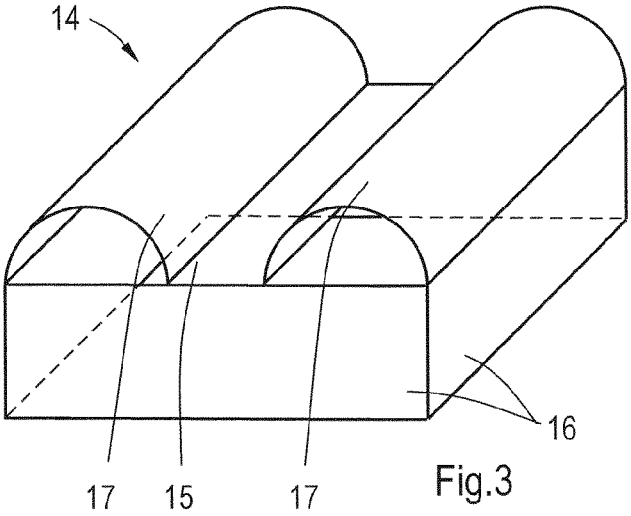
FIG. 3 is a perspective view of an embodiment of a lid for a container.

FIG. 3 shows a lid 14 for closing a container 1 as described hereinbefore. However, the lid 14 is also suitable for alternative containers which are provided with lifting straps in the form of loops at corners of box-shaped containers. The lid 14 has a box shape and comprises an upper wall 15 and four side walls 16. The lid 14 can have a square or rectangular cross section, depending on the shape of the container 1 to be covered. The upper wall 15 is provided with tunnel-shaped portions 17 which extend parallel to each other. If a container 1 is covered by the lid 14 the forks of a fork lift truck can be inserted into the tunnel-shaped portions 17 through the lifting straps of the container which are located below the lid 14, without removing are damaging the lid 14.

The lid 14 can be placed on the container 1 such that the four side walls 16 hang on the outer side of the circumferential wall of the container 1.

Figure 4:
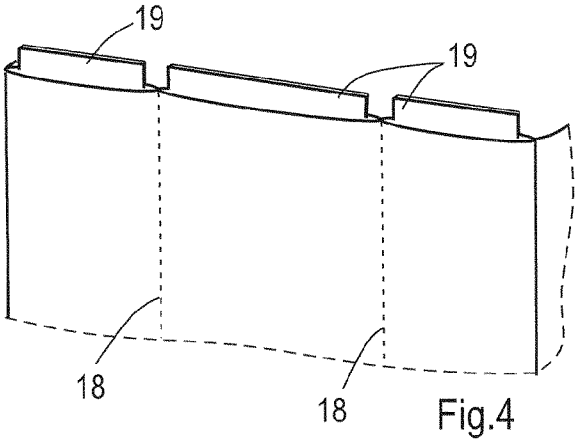
FIG. 4 is a perspective cut-away view of a portion of a side of the container according to FIGS. 1 and 2.

FIG. 4 shows a portion of one side wall of the container 1. The side wall is made of a double layer cloth, which is divided into three lodging parts by stitches 18 in which reinforcing plates 19 are inserted. For clarity reasons, FIG. 4 shows that the cloth is partly cut away. In the embodiment as shown in FIGS. 1 and 2 the reinforcement plates 19 are substantially entirely covered by the enveloping cloth material. One of the side walls that is provided with reinforcement plates 19 comprises at least a reinforcement plate 19 including a valve 20, see FIGS. 1, 2.

Figure 6:
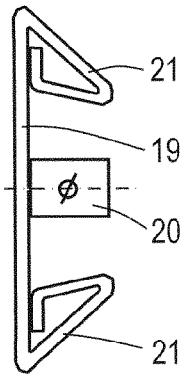
FIG. 6 is an enlarged side view of the embodiment of FIG. 5, illustrating the reinforcement plate including a valve.
Figure 5:
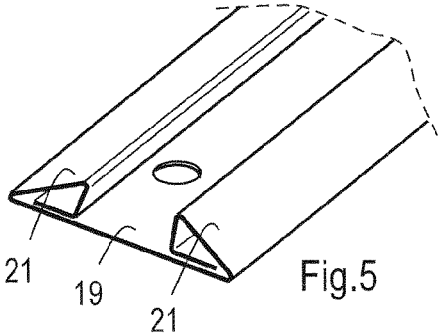
FIG. 5 is a perspective view of a portion of a reinforcement plate including a hole for receiving a valve.

FIG. 5 illustrates a portion of a reinforcement plate 19 including a hole for receiving a valve 20, and FIG. 6 shows a different view including the valve 20. This embodiment of the reinforcement plate 19 is provided with rigid reinforcement bars 21. When incorporated in the circumferential wall of the container 1 the reinforcement bars 21 extend upwardly with respect to the bottom 3 at both sides of the valve 20.

In the embodiment as shown in FIGS. 5 and 6 the distance between an outer side of the bars 21 and the reinforcement plate 19 is slightly larger than the distance between an outer side of the valve 20 and the reinforcement plate 19. This prevents the valve 20 from being damaged under practical conditions. For example, when a vehicle approaches the container 1 at the valve 20 the reinforcement bars 21 will protect the valve 20 when the vehicle hits the container 1. A further advantage of the reinforcement bars 21 is that bulging out of the reinforcement plate 19 in case of a filled big bag in the container 1 is minimized. This causes the valve 20 to remain in an appropriate position instead of tending downwardly due to bulging, preferably the valve 20 remains in a substantially horizontal position.

Furthermore, FIGS. 5 and 6 show that the reinforcing plate 19 and the reinforcement bars 21 are made of one piece. This is achieved by means of folding side edge portions of a flat reinforcement plate inwardly. It is noted that a lot of alternative folding shapes may be selected. In practice a flat reinforcement plate can be made of a light-weight material including folding lines to facilitate the manufacturing of the reinforcement bars 21, for example an extruded plastic sheet, but alternative materials are conceivable.

Figure 7:
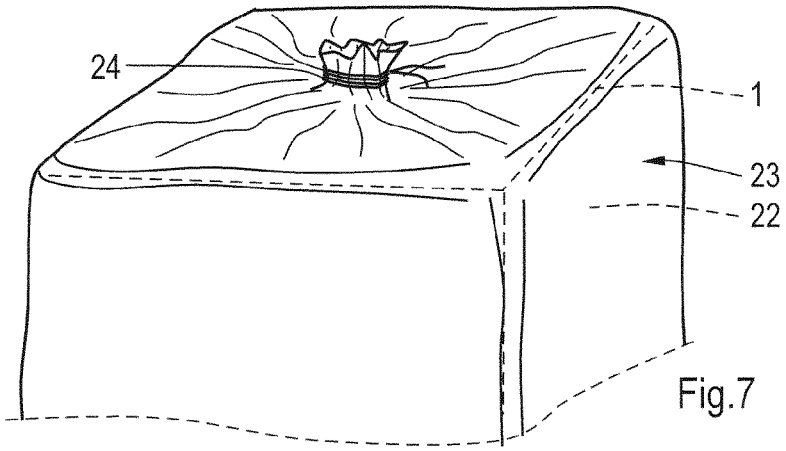
FIG. 7 is a perspective view of a big bag in a container including a tightening member.

An aspect of the present invention is also related to an assembly of a container 1 and a big bag 22, which is provided with a tightening member 23 for pulling opposite sides of the big bag at an upper portion thereof to each other in a filled condition. FIG. 7 shows an embodiment of the tightening member 23 which has a tubular shape and surrounds the big bag 22. The tightening member 23 may be a bag which envelopes the big bag 22, for example. FIG. 7 indicates the contours of the enveloping container 1 by dotted lines. The tubular tightening member 23 has an upper end portion which is provided with a circumferential drawing string 24. When pulling the drawing string 24 the upper end portion is pulled together as illustrated in FIG. 7. The tightening member 23 is partly clamped between the container 1 and the big bag 22 in a filled condition. Due to the shape of the filled big bag 22 including the tightened member 23 as shown in FIG. 7 the movement to-and-fro of the content of the big bag 22 at the upper portion of the container 1 is minimized. It is desired that the tightening member 23 contacts the upper portion of the big bag 22 such that curved top edges of the filled big bag arise, such as illustrated in FIG. 7.

The invention is not limited to the embodiment shown in the drawings and described hereinbefore, which may be varied in different manners within the scope of the claims.

The invention is related to the following aspects:

Aspect 1: A container (1) for receiving a big bag (22), having a box shape and comprising a bottom (2), a front side (3), an opposite rear side (4) and two opposite lateral sides (5, 6) extending between the front side (3) and the rear side (4), said sides (3-6) forming a circumferential wall of the container (1), front lifting straps (7) at corners (7*a*) where the front side (3) and the lateral sides meet (5, 6), and rear lifting straps (8) at corners (8*a*) where the rear side (4) and the lateral sides (5, 6) meet, at least two guides (9, 10) located at the respective lateral sides (5, 6) and joined to the respective corresponding rear lifting straps (8) such that under operating conditions forks of a fork lift truck can be guided by said guides (9, 10) through the rear lifting straps (8) after being moved through the front lifting straps (7) towards the rear lifting straps (8), wherein each rear lifting strap (8) has joint portions (11) where the strap (8) is joined to the guide (9, 10) and the rear side (4), and a free portion (12) extending between said joint portions (11), wherein the container (1) is adapted such that the free portions (12) of the respective rear lifting straps (8) allow the guides (9, 10) to be displaced between a location at least partly within the circumferential wall of the container (1) and a location outside the circumferential wall of the container (1).

Aspect 2: A container (1) according to aspect 1, wherein the respective joint portions (11) that are joined to the rear side (4) extend from respective fixing locations (13) at an upper edge portion of the rear side (4) obliquely downwards, wherein the fixing locations (13) are located at a distance from the respective corners (8*a*) where the respective rear side (4) and the lateral sides (5, 6) meet.

Aspect 3: A container (1) according to aspect 1 or 2, wherein the respective joint portions (11) that are joined to the guide (9, 10) are also joined to the respective lateral sides (5, 6), preferably along the respective corners (8*a*) where the rear side (4) and the lateral sides meet (5, 6).

Aspect 4: A container (1) according to one of the preceding aspects, wherein the guides (9, 10) are also joined to the respective front lifting straps (7).

Aspect 5: A container (1) according to one of the preceding aspects, wherein the guides (9, 10) extend parallel to each other along upper edge portions of the lateral sides (5, 6).

Aspect 6: A container (1) according to one of the preceding aspects, wherein the guides (9, 10) are tubular shaped.

Aspect 7: A container (1) according to one of the preceding aspects, wherein the guides (9, 10) are joined to the lateral sides (5, 6).

Aspect 8: A container (1) according to one of the preceding aspects, wherein the container (1) is substantially symmetric with respect to a plane extending transversely with respect to the bottom (2).

Aspect 9: A lid (14) for closing a container (1) according to one of the preceding aspects, wherein the lid (14) has a box shape including an upper wall (15) and side walls (16), wherein the upper wall (15) is provided with tunnel shaped portions (17) extending substantially parallel to each other and protruding in a direction away from the side walls (16).

Aspect 10: A container (1) for receiving a big bag (22), having a box shape and comprising a bottom (2) and side walls (3-6), wherein one of the side walls (3-6) comprises at least a reinforcement plate (19) including a valve (20), wherein the reinforcement plate (19) is provided with rigid reinforcement bars (21) extending upwardly with respect to the bottom (2) at both sides of the valve (20).

Aspect 11: A container (1) according to aspect 10, wherein the distance between an outer side of the bars (21) and the reinforcement plate (19) is the same as or larger than the distance between an outer side of the valve (20) and the reinforcement plate (19).

Aspect 12: A container (1) according to aspect 10 or 11, wherein the reinforcement plate (19) and the reinforcement bars (21) are made of one piece, preferably by means of folding side edge portions of a flat reinforcement plate inwardly.

Aspect 13: An assembly of a container (1) and a big bag (22), wherein the big bag (22) is received by the container (1), the container (1) having a box shape and comprising a bottom (2) and side walls (3-6), wherein the assembly is provided with a tightening member (23, 24) for pulling opposite sides of the big bag (22) at an upper portion thereof to each other in a filled condition.

Aspect 14: An assembly according to aspect 13, wherein the tightening member (23, 24) is attached to at least one of the side walls (3-6) o the bottom of the container (1).

Aspect 15: An assembly according to aspect 13 or 14, wherein the tightening member (23, 24) is attached to the side walls (3-6) by clamping a portion of the tightening member (23, 24) between the container (1) and the big bag (22) in a filled condition.

Aspect 16: An assembly according to one of the aspects, wherein the tightening member (23, 24) has a tubular shape and surrounds at least an upper portion of the big bag (22), wherein the tightening member (23, 24) has an upper end portion including a circumferential drawing string (24) for pulling the upper end portion together.

Figure 8:
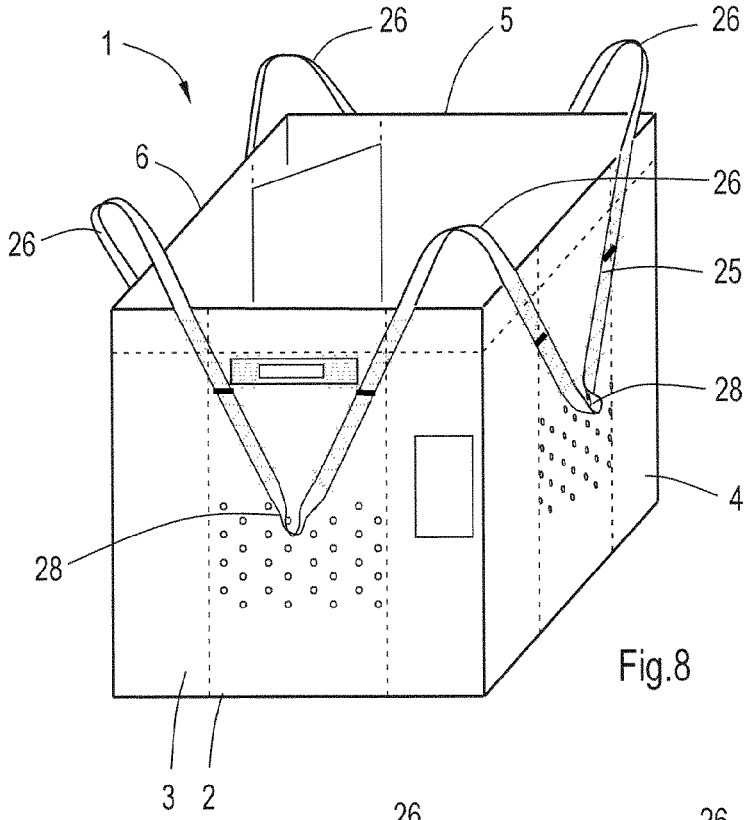
FIG. 8 is a similar view as FIG. 1, but showing a different embodiment of a container.

FIG. 8 shows an alternative embodiment of the invention. In this embodiment the container 1 has a block shape. The container 1 also comprises a bottom wall 2 and four side walls 3-6. The side walls 3-6 form a circumferential wall of the container 1. The container 1 is provided with a strap 25 which forms four lifting loops 26 at the upper side of the container 1.

More specifically the container 1 has four corners and the lifting loops 26 extend diagonally over the corners. This allows the container 1 to be taken up by a forklift truck by means of inserting the forks of the forklift truck through the lifting loops 26 from four different sides of the container 1.

The strap 25 is fixed to the side walls 3-6 in a diagonal fashion such that it forms a V-shape on each of the side walls 3-6 between two neighboring lifting loops 26. The strap 25 may be fixed to the side walls 3-6 by means of stitching. Furthermore, the strap 25 can be made of one piece, for example in a woven or braided material, or formed of a plurality of strap pieces which are secured to each other.

The side walls of the container 1 according to FIG. 8 may be made of a cloth material and reinforced by reinforcement plates, similar to the side wall as illustrated in the embodiment according to FIG. 4. Due to the V-shaped strap 25 on the side walls it appears to be possible to leave out the middle reinforcement plate 19 between neighboring corners. In that case the reinforcement plates 19 are located at corners where the side walls 3-6 meet each other, whereas central portions of the side walls 3-6 between the reinforcement plates 19 at the corners are free from reinforcement plates. The width of the central portion may be larger than half of the width of one of the reinforcement plates 19 at the corners, but it may also be larger than the entire width of the reinforcement plates 19 at the corners.

In the embodiment of FIG. 8 the central portions of the side walls 3-6 are provided with perforations for creating ventilation. This is advantageous for certain types of products, for example fruit or vegetables. The perforations are indicated by circles in FIG. 8. When the central portions are free from reinforcement plates the perforations can be made in an easy way. The total surface of the perforations may be larger than 1% of the circumferential surface of the container 1, but a larger percentage is conceivable.

Figure 9:
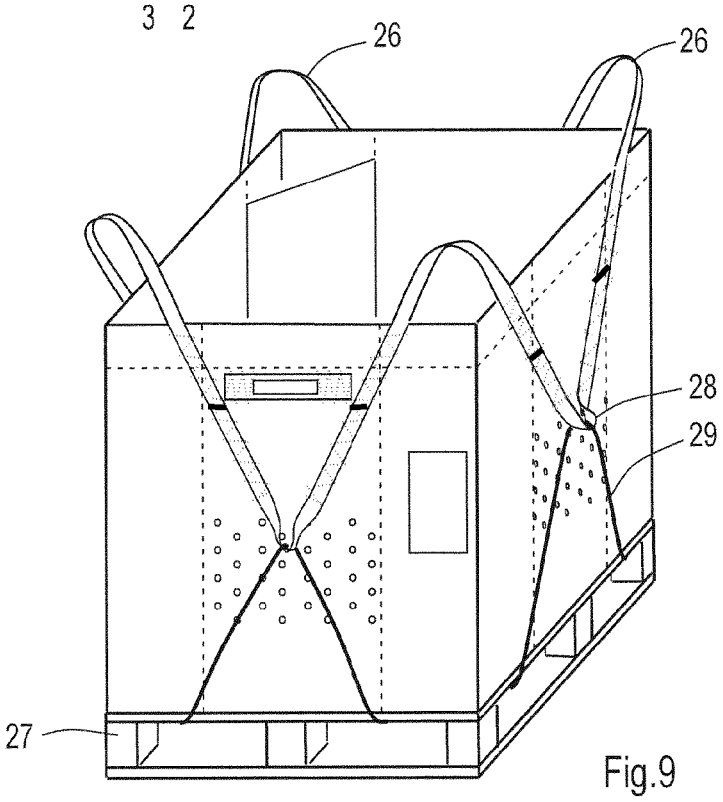
FIG. 9 is a similar view as FIG. 8, but showing the container attached to a pallet.

In the embodiment of the container 1 as shown in FIG. 8 the strap 25 is free from the side walls 3-6 at lower ends of the V-shapes. The loose or untight portions of the strap 25 form fastening loops 28 on the side walls 3-6. This provides the opportunity to attach the container 1 to a support 27 by means of a rope 28, which is illustrated in FIG. 9. Upon lifting the container 1 by means of the lifting loops 26 the support 27 will be lifted automatically, as well.

The invention claimed is:

1. A container system comprising:

a container, wherein the container includes:

a box shape;

a bottom wall;

side walls forming a circumferential wall of the container; and a strap forming four lifting loops at the upper side of the container and which is fixed to the side walls diagonally such that the strap forms a V-shape on each of said side walls between two adjacent lifting loops, wherein the strap is free from the side walls at lower ends of the V-shapes so as to form fastening loops;

a pallet configured to support the container, the pallet having holes; and a connector connecting the pallet to the strap using the fastening loops and the holes in the pallet, whereby upon lifting the container by the lifting loops the pallet will be lifted automatically.

2. The container system according to claim 1, wherein the container has four side walls forming four corners, wherein the lifting loops extend diagonally over said corners.

3. The container system according to claim 1, wherein the strap is formed of a plurality of strap pieces which are secured to each other.

4. The container system according to claim 1, wherein the side walls are made of a cloth material and reinforced by reinforcement plates.

5. The container system according to claim 4, wherein the reinforcement plates are located at corners where adjacent side walls meet each other, whereas central portions of the side walls are free from reinforcement plates, wherein a width of a central portion of a side wall is larger than half of a width of one of the reinforcement plates at the corners.

6. The container system according to claim 1, wherein the side walls and/or the bottom wall are provided with perforations for creating ventilation.

7. The container system according to claim 6, wherein a total surface of the perforations is larger than 1% of a circumferential surface of the container.

8. The container system according to claim 1, wherein the container further comprises at least two guides located at the respective lateral sides and joined to the respective corresponding front and rear lifting straps and configured such that under operating conditions forks of a fork lift truck can be guided by said guides through the rear lifting straps after being moved through the front lifting straps towards the rear lifting straps.

9. The container system according to claim 1 wherein the connector comprises a rope.

10. The container system according to claim 9 wherein the rope is drawn through a plurality of holes in the pallet and a plurality of fastening loops.

* * * * *